US010688338B2

(12) United States Patent
Hsu

(10) Patent No.: US 10,688,338 B2
(45) Date of Patent: Jun. 23, 2020

(54) EXERCISE MECHANISM FOR TRAINING MACHINE

(71) Applicant: GEE HOO FITEC CORP., New Taipei (TW)

(72) Inventor: Ching-Lu Hsu, Taipei (TW)

(73) Assignee: GEE HOO FITEC CORP., New Taipei (TW)

( * ) Notice: Subject to any disclaimer, the term of this patent is extended or adjusted under 35 U.S.C. 154(b) by 112 days.

(21) Appl. No.: 15/969,558

(22) Filed: May 2, 2018

(65) Prior Publication Data

US 2019/0336819 A1 Nov. 7, 2019

(51) Int. Cl.
*A63B 22/06* (2006.01)
*A63B 21/04* (2006.01)
(Continued)

(52) U.S. Cl.
CPC .... *A63B 22/0664* (2013.01); *A63B 21/00192* (2013.01); *A63B 21/0435* (2013.01);
(Continued)

(58) Field of Classification Search
CPC . A63B 23/00; A63B 23/035; A63B 23/03575; A63B 23/03583; A63B 23/03591; A63B 23/04; A63B 23/405; A63B 23/0417; A63B 23/0423; A63B 23/0429; A63B 23/0476; A63B 23/1209; A63B 23/1263; A63B 23/1272; A63B 21/00; A63B 21/00181; A63B 21/008; A63B 21/0083; A63B 21/0085; A63B 21/0087; A63B 21/00192; A63B 21/012; A63B 21/015; A63B 21/22; A63B 21/225; A63B 21/227; A63B 21/4041; A63B 21/4047; A63B 21/4049; A63B 22/001; A63B 22/0002; A63B 22/0005; A63B 22/0025; A63B 22/0046; A63B 22/0048; A63B 22/0061; A63B 22/0064; A63B 22/0066; A63B 2022/0035; A63B 2022/0041; A63B 2022/0043;
(Continued)

(56) References Cited

U.S. PATENT DOCUMENTS 8,814,757 B2 * 8/2014 Eschenbach ..... A63B 21/00069 482/52
2009/0176624 A1 * 7/2009 Chang ..... A63B 22/001 482/52
2014/0336006 A1 * 11/2014 Miller ..... A63B 21/154 482/52

* cited by examiner

*Primary Examiner* — Loan B Jimenez
*Assistant Examiner* — Zachary T Moore
(74) *Attorney, Agent, or Firm* — Tracy M Heims; Apex Juris, PLLC.

(57) ABSTRACT

An exercise mechanism for a training machine is disclosed wherein the training machine includes a machine base and at least one handle which is operable to swing. The exercise mechanism includes at least one support and a rotary disk, wherein the at least one support is pivotally connected to the machine base and has a first end and a second end which are respectively on two sides of a portion pivoted to the machine base; the at least one support moves to generate a relative up and down displacement between the first end and the second end when the handle swings; the first end is pivotally connected to the machine base via a linkage assembly; the rotary disk would be driven to rotate when the second end moves whereby the exercise mechanism is capable of operating the training machine.

7 Claims, 7 Drawing Sheets

(51) Int. Cl.
*A63B 21/22* (2006.01)
*A63B 22/00* (2006.01)
*A63B 21/00* (2006.01)

(52) U.S. Cl.
CPC ..... *A63B 21/159* (2013.01); *A63B 21/227* (2013.01); *A63B 21/4034* (2015.10); *A63B 21/4035* (2015.10); *A63B 22/001* (2013.01); *A63B 22/0005* (2015.10); *A63B 2022/0676* (2013.01)

(58) Field of Classification Search
CPC .... A63B 2022/0053; A63B 2208/0028; A63B 2208/0233
USPC ..... 482/52, 62, 142
See application file for complete search history.

EXERCISE MECHANISM FOR TRAINING MACHINE

BACKGROUND OF THE INVENTION

Technical Field

The present invention relates generally to a training machine, and more specifically to an exercise mechanism of a training machine.

Description of Related Art

With the improvement in people's living standard, people's attention on their health is also increasing. Among them, many people would exercise to stay healthy, thereby leading a country-wide trend of exercise. Sport machine manufacturers are encouraged to manufacture various kinds of products for sports consumers. Wherein, since outdoor sports are easy to be limited by weather condition, it impossible for people to exercise whenever they want to do that. Therefore, indoor sports have become a better choice for most of the people, and training machines are provided to help people to obtain better exercise result when they exercise indoors.

However, most of the training machines are usually launched into the market with the sports trend rapidly and do not include a well-designed exercise mechanism such that the training machines could not achieve an expected result or provide a better performance for the people who use the training machines due to the problems of the exercise mechanism.

BRIEF SUMMARY OF THE INVENTION

In view of the above, an object of the present invention is to provide an exercise mechanism for a training machine which could facilitate an operation of the training machine.

The present invention provides an exercise mechanism for a training machine, wherein the training machine includes a machine base and at least one handle which is operable to swing. The exercise mechanism includes at least one support and a rotary disk, wherein the at least one support is pivotally connected to the machine base and has a first end and a second end which are respectively on two sides of a portion pivoted to the machine base; the at least one support moves to generate a relative up and down displacement between the first end and the second end when the handle swings; the first end is pivotally connected to the machine base via a linkage assembly; the rotary disk would be driven to rotate when the second end moves.

The advantage of the present invention is to enable the training machine to provide a required fitness effect when a user operates the training machine.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
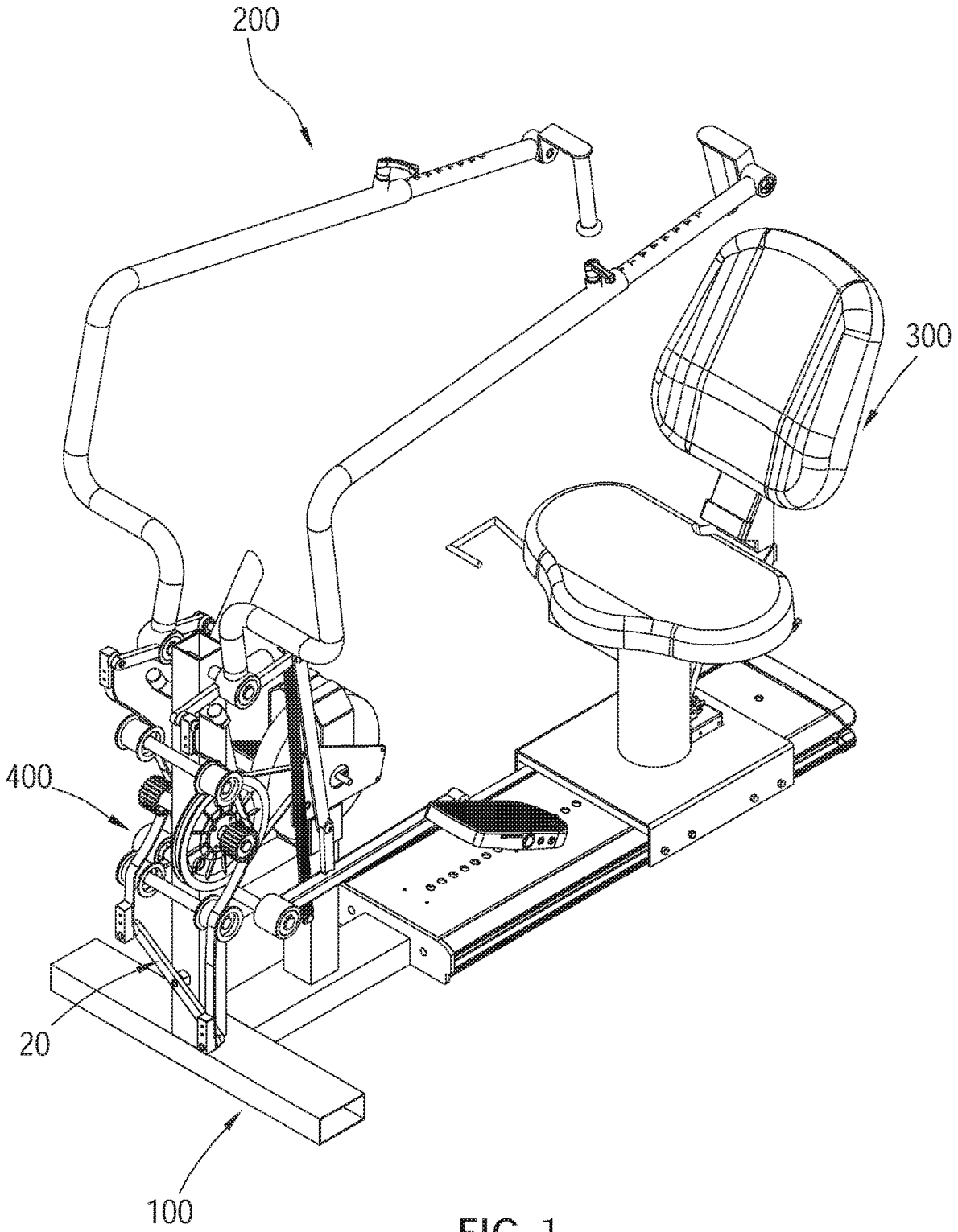
FIG. 1 is a perspective view of an exercise mechanism of a training machine according to an embodiment of the present invention.
Figure 2:
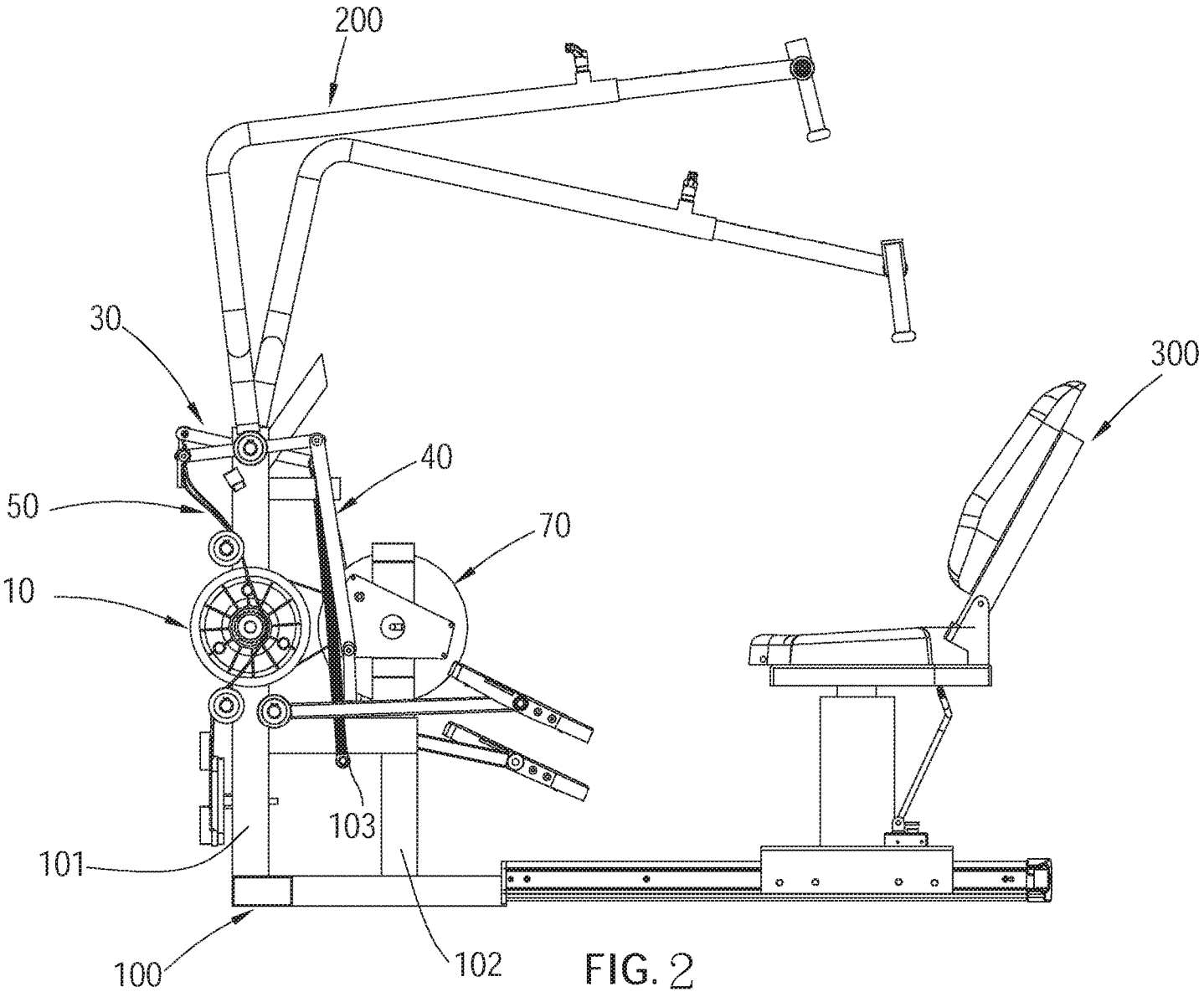
FIG. 2 is a side view of the training machine of FIG. 1.

The present invention will now be described in detail with reference to a few preferred embodiments thereof as illustrated in the accompanying drawings. As shown in FIG. 1 and FIG. 2, a sport training machine 100 of a first embodiment according to the present invention includes a machine base 10, two handles 20, a seat 30 and an exercise mechanism 40. Wherein, the machine base 100 could be stably placed on the floor, and the machine base 100 has a first post 101 and a second post 102 which are vertically disposed. The two handle 200 are symmetrically disposed on two sides of the first post 101 of the machine base 100. The seat 300 is provided on the machine base 100, wherein the seat 300 could be adjusted to be close to or away from the exercise mechanism 400 so as to be suitable for users having different figures. Meanwhile, the seat 300 is rotatable to enable the user to control the handles 200 at different positions. According to the current embodiment, the exercise mechanism 400 includes a rotary disk 10, a swing member 20, and two supports 30 which are corresponding to the two handles 200, two linkage assemblies 40, two first belts 50 and two first resistance units. For the convenience of illustration, only a set of one handle 200, one support 30, one linkage assembly 40, and one first belt 50 will be described in details in the following paragraphs. In addition, in other embodiments, when the training machine includes a single handle, the exercise mechanism may only include one support, one linkage assembly, one first belt, and a first resistance unit corresponding to the single handle.

Figure 3:
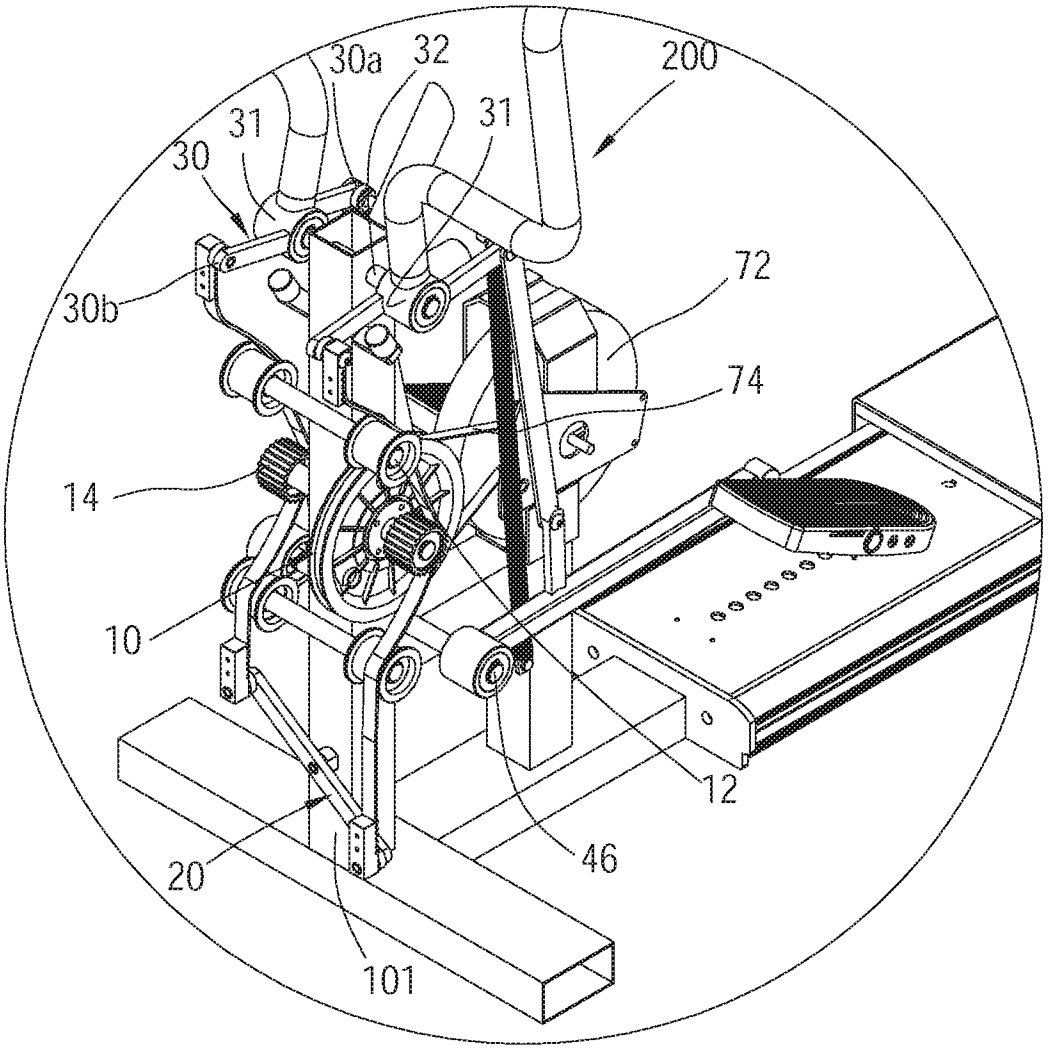
FIG. 3 is a partial enlarged view of the training machine of FIG. 1.
Figure 4:
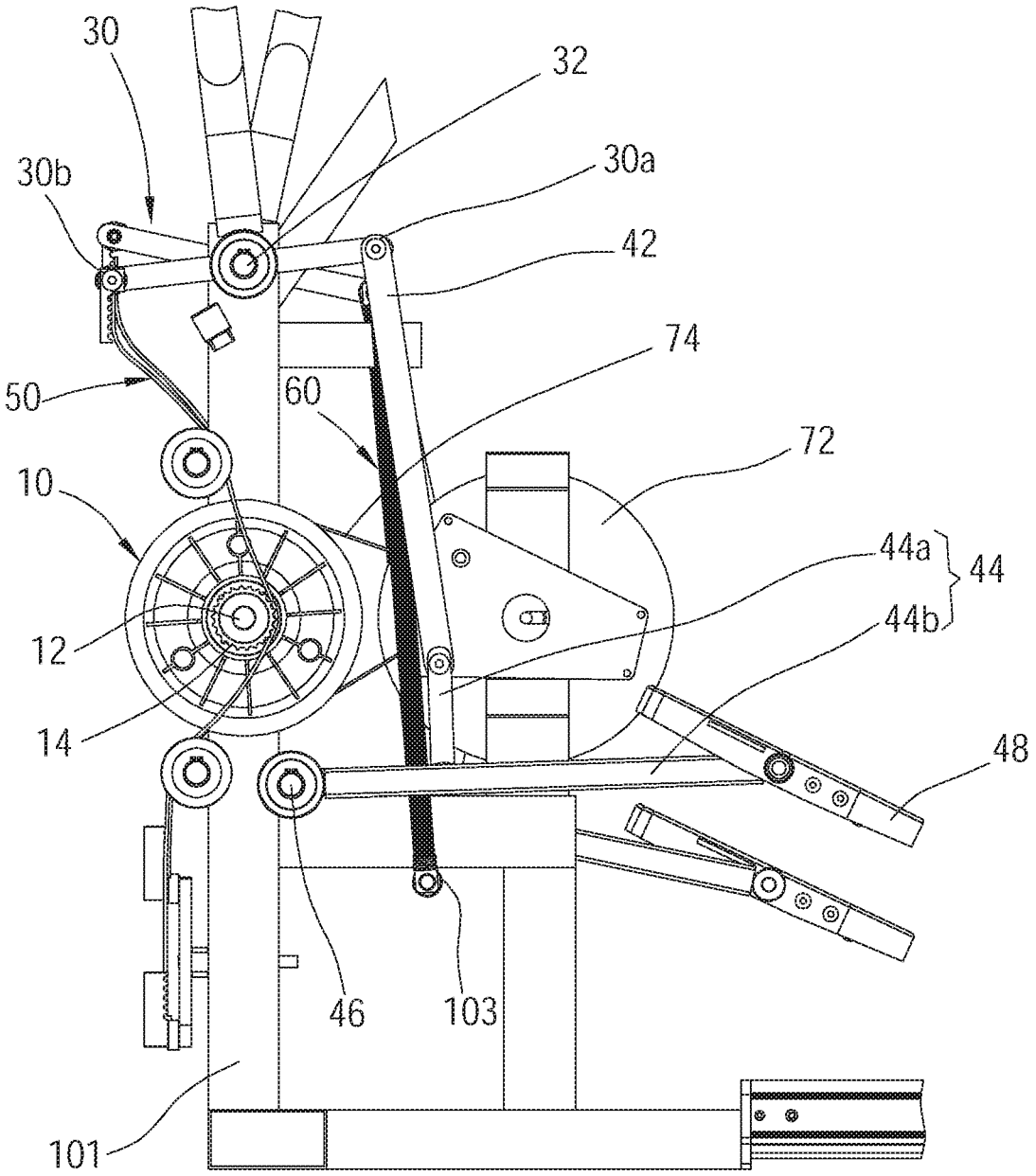
FIG. 4 is a side view of the training machine of FIG. 3.

As illustrated in FIG. 3 and FIG. 4, the rotary disk 10 is disposed at a middle portion of the first post 101 and a shaft 12 passes through the rotary disk 10 and penetrates through the first post 101, wherein each of two ends of the shaft 12 is mounted with a one-way bearing (not shown); each one-way bearing is further disposed with a gear 14. The swing member 20 is a long rod as an example, and is pivotally connected to a lower part of the first post 101 and disposed on a front surface of the first post 101.

Figure 6:
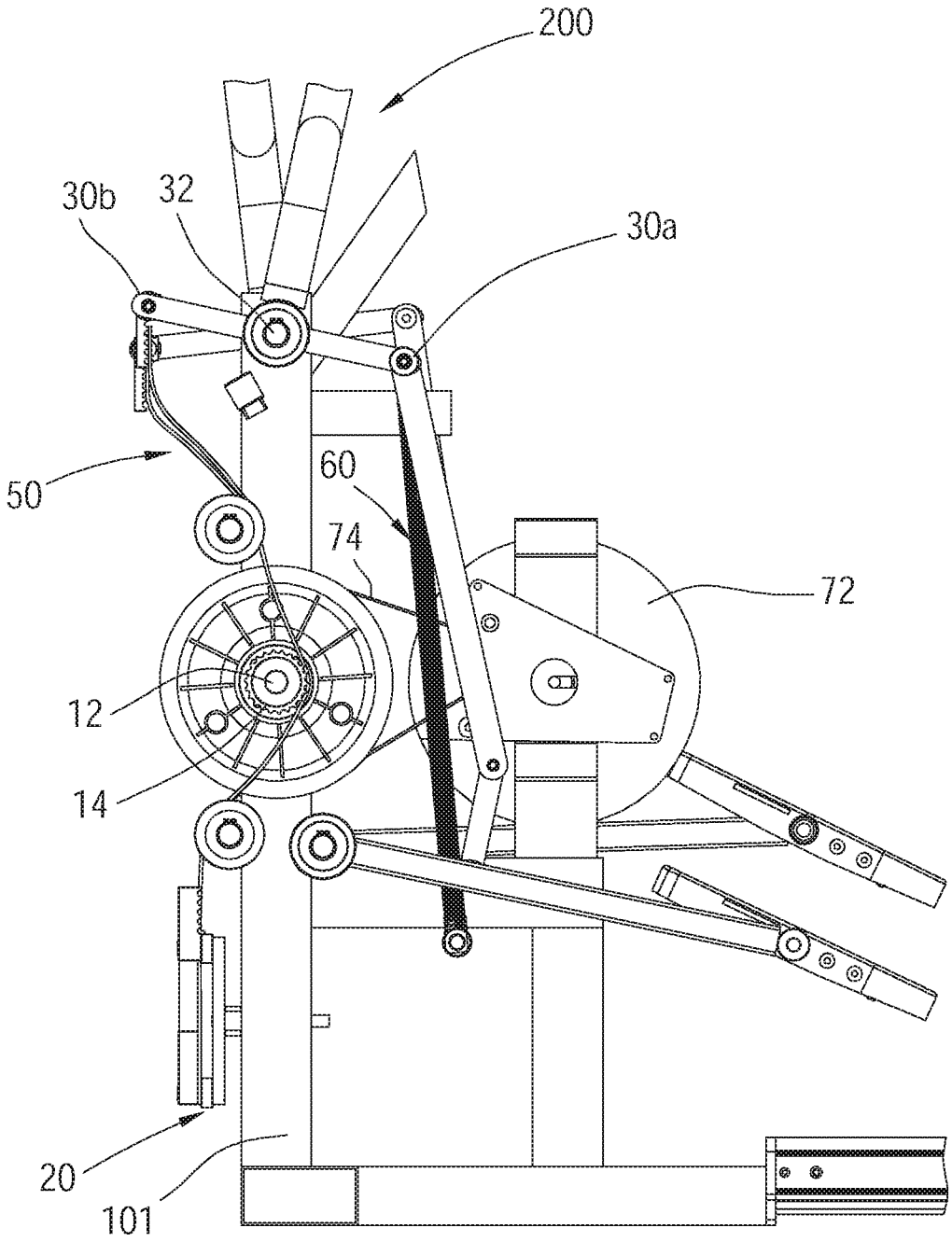
FIG. 6 is a side view of the exercise mechanism of the training machine according to the embodiment of the present invention.

Another shaft 32 passes through each middle pivoted portion 31 of the two supports 30 to make the two supports 30 be pivotally connected to left and right sides of the first post 101 respectively. Each of the support 30 has a first end 30*a* and a second end 30*b* corresponding to two sides of the pivoted portion 31 thereof, wherein the first end 30*a* is closer to the user than the second end 30*b*. One end of each of the handles 200 is fixed to each middle portion of the corresponding support 30 such that the supports 30 could swing together with the handles 200 when the user operates the handles 200 to move, that is, a relative up and down displacement would be generated between the first end 30*a* and the second end 30*b* of each of the supports 30 (as shown in FIG. 4 and FIG. 6).

The first end 30*a* of the support 30 is pivotally connected to the machine base 100 via the linkage assembly 40, and more specifically, the linkage assembly 40 includes a first link 42 and a second link 44, wherein one end of the first link 42 is pivotally connected the first end 30*a* of the support 30; one end of the second link 42 is pivotally connected to the machine base 100; the first link 42 and the second link 44 are pivotally connected with each other. In one embodiment, the second link 44 includes a vertical rod 44*a* and a cross rod 44*b*, wherein one end of the vertical rod 44*a* is pivotally connected to the first link 42, and another end of the vertical rod 44*a* is connected to a body of the cross rod 44*b*. One end of the cross rod 44*b* is pivoted to the machine via a shaft 46, and another end of the cross rod 44*b* is provided with a pedal 48. In other words, the handle 200 would drive the support 30 to move when the user operates the handle 200 to swing up and down, or the linkage assembly 40 would drive the support 30 to swing when the user sits on the seat 300 and treads the pedal 48 to drive the linkage assembly 40 to move, which achieves the same effect as operating the handle 200 with the user's hands. In addition, the user also could drive the support 30 to move with both of his hands and feet.

Figure 5:
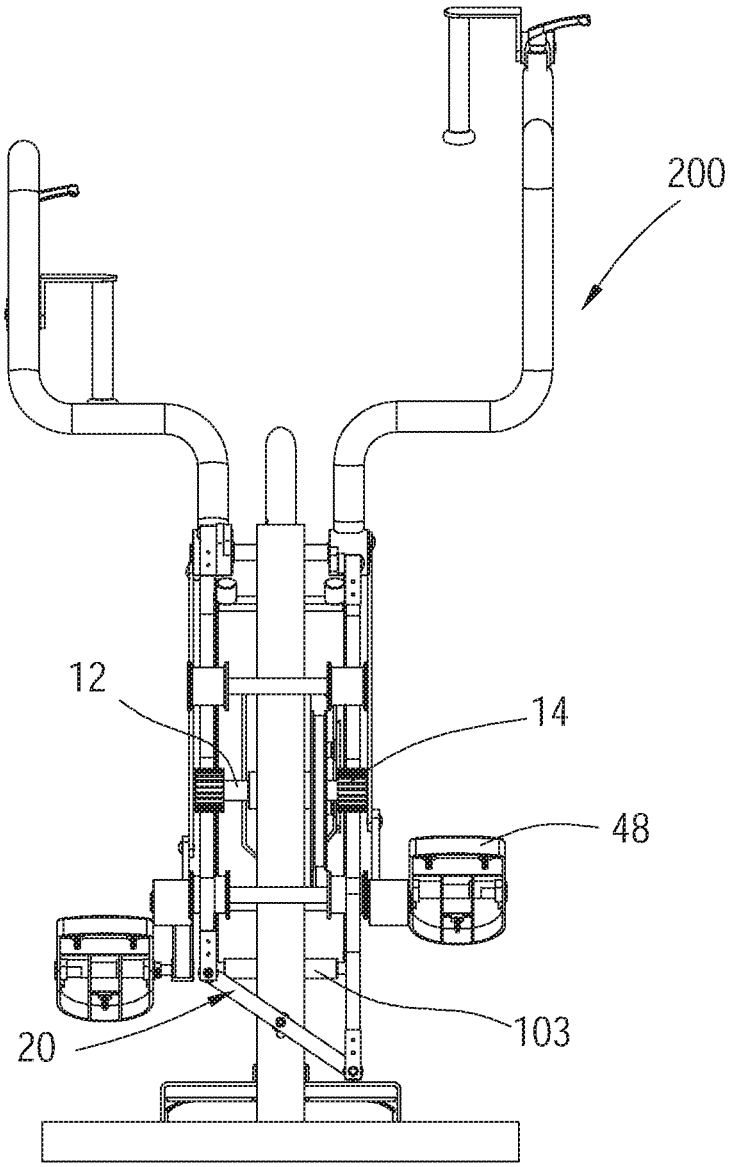
FIG. 5 is a front view of the training machine of FIG. 3.
Figure 7:
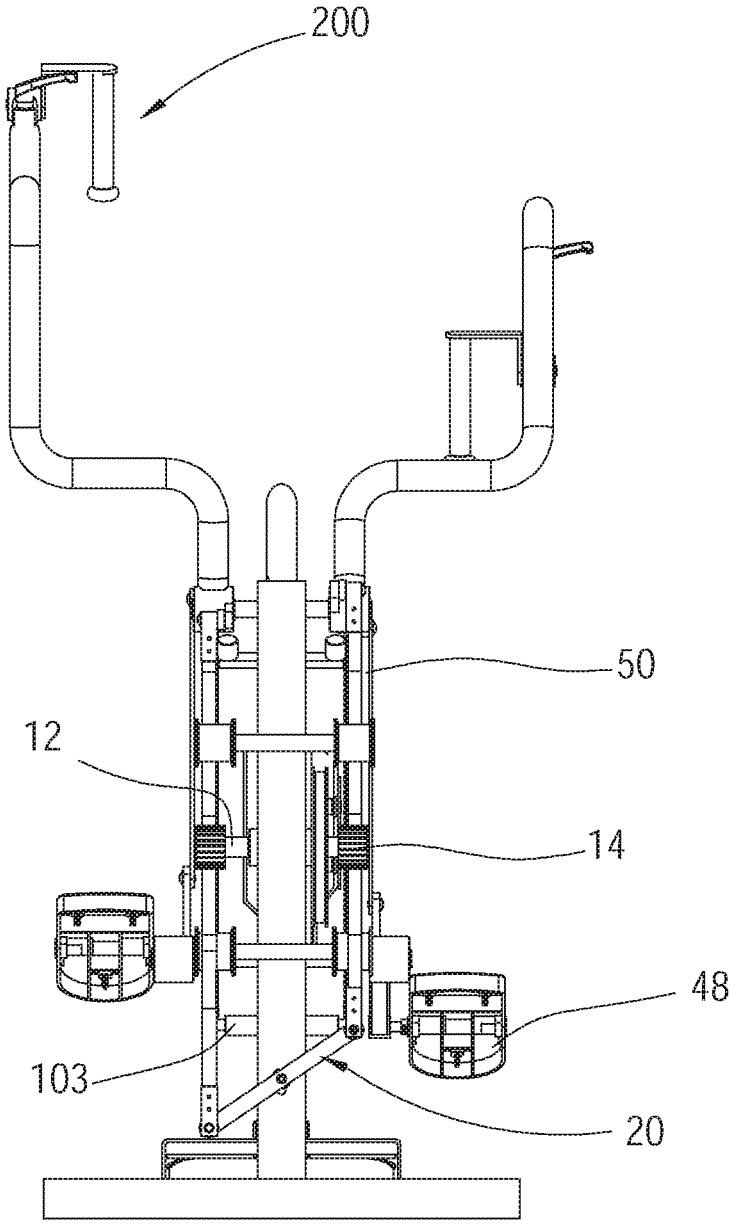
FIG. 7 is a front view of the exercise mechanism of the training machine of FIG. 6.

The second end 30*b* of the support 30 is connected to one end of the swing member 20 through the first belt 50, and the first belt 50 is in contact with the gear 14. The first belt 50 would be pulled to move by the support 30 indirectly when the user operates the support 30 to swing, wherein when the first belt 50 moves, not only the swing member 20 would be driven to swing (as shown in FIG. 5 and FIG. 7), but also the rotary disk 10 would be driven to rotate due to the friction generated between the first belt 50 and the gear 14, which are in contact with each other. Moreover, since the gear 14 is fit around the one-way bearing, the rotary disk 10 could be kept to rotate in the same direction when the handles 200 are operated to pull or release the first belts 50 at the left and right sides via the supports 30.

The first end 30*a* of the support 30 could be selectively connected with the first resistance unit for generating an appropriate resistance to the swing of the support 30, thereby increasing the exercise and fitness effect. As illustrated in FIG. 4 and FIG. 6, in the current embodiment, the first resistance unit 60 is a spring as an example, wherein one end of the spring 60 is connected to the first end 30*a*, and another end of the spring 60 is connected to a fixing post 103 of the machine base 100. When the first end 30*a* is relatively higher than the second end 30*b*, the spring 60 would be stretched to generate a counter force having a direction opposite to the stretching direction, which provides a swing resistance to the supports 30 to make the user to operate the handles 200 with a greater force, thereby achieving a better exercise or rehabilitation effect.

The rotary disk 10 could be connected with a second resistance unit 70 for increasing the resistance. The second resistance unit 70 has a flywheel 72 and a second belt 74, wherein the second belt 74 is adapted to connect the rotary disk 10 with the flywheel 72 such that the rotary disk 10 could drive the flywheel 72 to rotate. The flywheel 72 is operable to change a rotation resistance thereof, for example, when the flywheel is a magnetron flywheel, the rotation resistance could be changed by adjusting an amount of the magnetic force. It is worth mentioning that although the training machine of the current embodiment includes the first resistance unit 60 and the second resistance unit 70, however, in other embodiments, the training machine also could only include the first resistance unit or the second resistance unit.

It must be pointed out that the embodiments described above are only some embodiments of the present invention. All equivalent structures which employ the concepts disclosed in this specification and the appended claims should fall within the scope of the present invention.

What is claimed is:

1. An exercise mechanism for a training machine, wherein the training machine includes a machine base and at least one handle which is operable to swing, the exercise mechanism comprising:

at least one support, being pivotally connected to the machine base and having a first end and a second end which are respectively on two sides of a portion pivoted to the machine base;

a rotary disk; wherein the first end and the second end of the at least one support move to generate a relative up and down displacement when the handle swings; the first end is pivotally connected to the machine base via a linkage assembly; the rotary disk would be driven to rotate when the second end moves;

a swing member and a first belt, wherein the swing member is pivotally connected to the machine base; the first belt has two ends with one of the two ends connected to the second end of the support and the other end of the two ends connected to the swing member; the rotate disk is driven to rotate by the first belt; and a shaft and at least one gear, wherein the shaft passes through the machine base and the rotary disk; the at least one gear is fit around one end of the shaft; the first belt is in contact with the at least one gear.

2. The exercise mechanism of claim 1, further comprising a first resistance unit adapted to provide a resistance to the swinging of the at least one support.

3. The exercise mechanism of claim 2, wherein the first resistance unit includes a spring; one end of the spring is connected to the at least one support, and another end of the spring is connected to the machine base.

4. The exercise mechanism of claim 1, wherein the first end is closer to the user than the second end.

5. The exercise mechanism of claim 1, wherein the linkage assembly includes a first link and a second link; one end of the first link is pivotally connected to the first end of the at least one support; the second link is pivotally connected to the machine base; the first link and the second link are pivotally connected with each other.

6. The exercise mechanism of claim 1, wherein the second link includes a vertical rod with a cross rod; one end of the vertical rod is pivotally connected to the first link, and another end of the vertical rod is connected to a body of the cross rod; one end of the cross rod is pivotally connected to the machine base, and another end of the cross rod is disposed with a pedal.

7. The exercise mechanism of claim 1, further comprising a second resistance unit disposed on the machine base, wherein the second resistance unit includes a flywheel and a second belt; the second belt is adapted to connect the rotary disk with the flywheel.

* * * * *